US012631025B2

(12) United States Patent
Steinberg et al.

(10) Patent No.: US 12,631,025 B2
(45) Date of Patent: May 19, 2026

(54) ELONGATED CEILING GRID MEMBER

(71) Applicant: TATE ACCESS FLOORS, INC., Jessup, MD (US)

(72) Inventors: Benjamin L. Steinberg, Baltimore, MD (US); Daniel B. Kennedy, Lovettsville, VA (US); Christopher G. Buss, Washington, DC (US)

(73) Assignee: TATE ACCESS FLOORS, INC., Jessup, MD (US)

( * ) Notice: Subject to any disclaimer, the term of this patent is extended or adjusted under 35 U.S.C. 154(b) by 276 days.

(21) Appl. No.: 18/125,344

(22) Filed: Mar. 23, 2023

(65) Prior Publication Data

US 2024/0318423 A1 Sep. 26, 2024

(51) Int. Cl.
*E04B 9/00* (2006.01)
*E04B 9/06* (2006.01)
*E04B 9/20* (2006.01)

(52) U.S. Cl.
CPC ..... *E04B 9/006* (2013.01); *E04B 9/064* (2013.01); *E04B 9/20* (2013.01)

(58) Field of Classification Search
CPC . E04B 9/006; E04B 9/064; E04B 9/20; E04B 9/067; E04C 2003/0413
See application file for complete search history.

(56) References Cited

U.S. PATENT DOCUMENTS 3,067,323 A * 12/1962 Kember ..... E04B 9/006 52/762
3,327,438 A 6/1967 Cooper
3,566,561 A 3/1971 Tozer
4,545,697 A * 10/1985 Verdenne ..... F16B 37/046 403/252

(Continued)

FOREIGN PATENT DOCUMENTS

EP 1 984 582 B1 1/2015
GB 2167779 A 6/1986

(Continued)

OTHER PUBLICATIONS

Sep. 3, 2019 Office Action issued in U.S. Appl. No. 16/354,915.

(Continued)

*Primary Examiner* — Brent W Herring
(74) *Attorney, Agent, or Firm* — Oliff PLC

(57) ABSTRACT

An elongated ceiling grid member that includes an upper portion that extends along the longitudinal axis of the elongated ceiling grid member and is configured to receive and engage a first set of one or more fastener members, a lower portion that extends along the longitudinal axis and is configured to receive and engage a second set of one or more fastener members and a middle portion between the upper and lower portions that is configured to receive and engage one or more supports. The lower portion and the middle portion are configured such that supports engaged by the middle portion are received through the lower portion. The (Continued)

upper portion may be designed to receive and engage a first channel nut and the lower portion may be configured to receive and engage a second channel nut. The middle portion may include a pair of spaced and parallel threaded side walls that form a threaded opening.

17 Claims, 7 Drawing Sheets

(56) References Cited

U.S. PATENT DOCUMENTS

| | | | | |
|---|---|---|---|---|
| 5,118,233 | A * | 6/1992 | Mitchell | F16B 37/045 411/85 |
| 5,414,967 | A * | 5/1995 | Cates | E04B 2/7455 52/241 |
| 6,158,186 | A * | 12/2000 | Feller | E04B 9/14 52/506.07 |
| 6,209,275 | B1 | 4/2001 | Cates et al. | |
| 6,615,556 | B2 | 9/2003 | Cates et al. | |
| 7,260,919 | B1 * | 8/2007 | Spransy | E04B 9/02 52/655.1 |
| 7,886,496 | B1 * | 2/2011 | Spransy | E04B 9/127 52/506.07 |
| 9,771,718 | B1 * | 9/2017 | Curtin | E04C 3/07 |
| 10,590,649 | B1 | 3/2020 | Morrison et al. | |
| D901,038 | S * | 11/2020 | Kennedy | D25/61 |
| 11,814,840 | B2 * | 11/2023 | Frame | E04B 9/064 |
| D1,029,297 | S * | 5/2024 | Koval | D25/164 |
| 2012/0240495 | A1 | 9/2012 | Eychaner et al. | |
| 2015/0000236 | A1 * | 1/2015 | Yang | F24F 13/28 55/482 |
| 2015/0275505 | A1 | 10/2015 | Thompson | |
| 2017/0292269 | A1 * | 10/2017 | Tornqvist | E04B 9/064 |
| 2018/0100305 | A1 * | 4/2018 | Curtin | E04B 9/20 |
| 2023/0332403 | A1 | 10/2023 | Frame et al. | |

FOREIGN PATENT DOCUMENTS

| | | | |
|---|---|---|---|
| GB | 2389376 | A | 12/2003 |
| WO | 2008115233 | A1 | 9/2008 |

OTHER PUBLICATIONS

Feb. 2, 2025 Extended European Search Report issued in European Patent Application No. 24193426.4.

Jan. 13, 2026 Office Action issued in Japanese Patent Application No. 2024-135335, with partial translation.

Jan. 13, 2026 Office Action issued in Japanese Patent Application No. 2024-135335.

* cited by examiner

ELONGATED CEILING GRID MEMBER

FIELD OF THE INVENTION

This invention relates to elongated ceiling grid members that are attached at their ends to form a grid or array of such members. Such grids or arrays (1) usually consist of parallel and perpendicular rows of the members and (2) are attached to and suspended from ceilings of rooms and other building spaces, such as office spaces, storage areas, and data centers, to function as the framework for directly and/or indirectly supporting other structural members and/or room or building accessories. In particular, this invention relates to such elongated ceiling grid members that are configured to receive and retain fastening members to which rods or other members can be attached to (1) attach the grid or array to a ceiling, (2) attach the elongated ceiling grid members to each other at junctions of the grid or array and/or (3) attach other structural members or building accessories to the grid or array.

BACKGROUND OF THE INVENTION

Ceiling grid assemblies comprised of a plurality of elongated ceiling grid members connected at their ends to form parallel and perpendicular rows of the elongated ceiling grid members have been in use for decades. Those ceiling grid assemblies are usually directly attached to and suspended from the structure comprising the ceiling of a room or other building space, such as a concrete slab. The elongated ceiling grid members of those ceiling grid assemblies directly or indirectly support other structural members and room or building accessories, such as light fixtures, HVAC conduits, sprinkler systems, cable trays, electrical busbars, hot/cold aisle partitions, etc., in the rooms or other building spaces in which they are installed.

In certain applications, it is desirable that a variety of other structural members and room or building accessories, of varying loads, can be attached to or otherwise supported by the elongated ceiling grid members at various locations along the elongated ceiling grid members. That variety of other structural members and room or building accessories may be attached to the elongated ceiling grid members with members of different sizes, for example, threaded rods of different diameters.

While elongated ceiling grid members for ceiling grid assemblies have been developed that have the capability that other structural members and room or building accessories can be attached to the elongated ceiling grid members at various locations along the elongated ceiling grid members, there is a need for elongated ceiling grid members to which different sized members can be readily and easily attached, with possibly different load requirements.

In addition, there is also a need for improved elongated ceiling grid members that can be attached to the ceiling at variable locations along their lengths.

Further, there is a need for elongated ceiling grid members that are easy to install, stable and have sufficient strength to bear the loads of the other structural members and accessories attached to and suspended from the elongated grid members.

This invention addresses those needs, as well as other needs that are readily apparent to those of skill in the art.

SUMMARY OF THE INVENTION

The elongated ceiling grid members of some embodiments of this invention include an upper portion that (i) extends along the longitudinal axis of the elongated ceiling grid member and (ii) is configured to receive and engage a first set of one or more fastener members, a lower portion that (i) extends along the longitudinal axis and (ii) is configured to receive and engage a second set of one or more fastener members, and a middle portion that (i) is between the upper and lower portions in an up-down direction perpendicular to the longitudinal axis, (ii) extends in the longitudinal direction and (iii) is configured to receive and engage a first set of one or more supports. The lower portion and the middle portion may be configured such that when the first set of one or more supports are engaged with the middle portion, the first set of one or more supports may pass through the lower portion.

In certain embodiments of the invention, the upper portion may define a first space that extends along the longitudinal axis and is open at a first opening at a top of the upper portion. The upper portion may be configured such that a second set of one or more supports connected to the first set of one or more fastener members may pass through the first opening. The lower portion may define a second space that extends along the longitudinal axis and is open at a second opening at a bottom of the lower portion. The lower portion may be configured such a third set of one or more supports connected to the second set of one or more fastening members may pass through the second opening. The lower portion and the middle portion may be configured such that, when the one or more supports are engaged with the middle portion, the one or more supports may pass through the second opening.

In other embodiments of the invention, the upper portion may be configured such that the first set of one or more fastener members is received in the first space and the lower portion may be configured such that the second set of one or more fastener members is received in the second space.

In yet other embodiments of the invention, the first set of one or more fastener members may include a first channel nut. The upper portion may include a first pair of inwardly extending and spaced flanges that engage and retain the first channel nut. Each of those inwardly extending and spaced flanges may include a tongue that extends downwardly and engages a groove of the first channel nut.

In further embodiments of the invention, the second set of one or more fastener members may include a second channel nut. The lower portion may include a second pair of inwardly extending and spaced flanges that engage and retain the second channel nut. Each of those inwardly and extending flanges may include a tongue that extends upwardly and engages a groove of the second channel nut.

In yet other embodiments of the invention, the middle portion may include a pair of spaced threaded walls that are configured to engage a threaded member and extend in parallel in an up-down direction.

In further embodiments of the invention, each of the second pair of inwardly extending and spaced flanges may include an outward extending portion configured to support a ceiling panel.

In other embodiments of the invention, each of the upper portion, the middle portion and the lower portion extends the length of the elongated ceiling grid members along the longitudinal axis.

DETAILED DESCRIPTION

Figure 1:
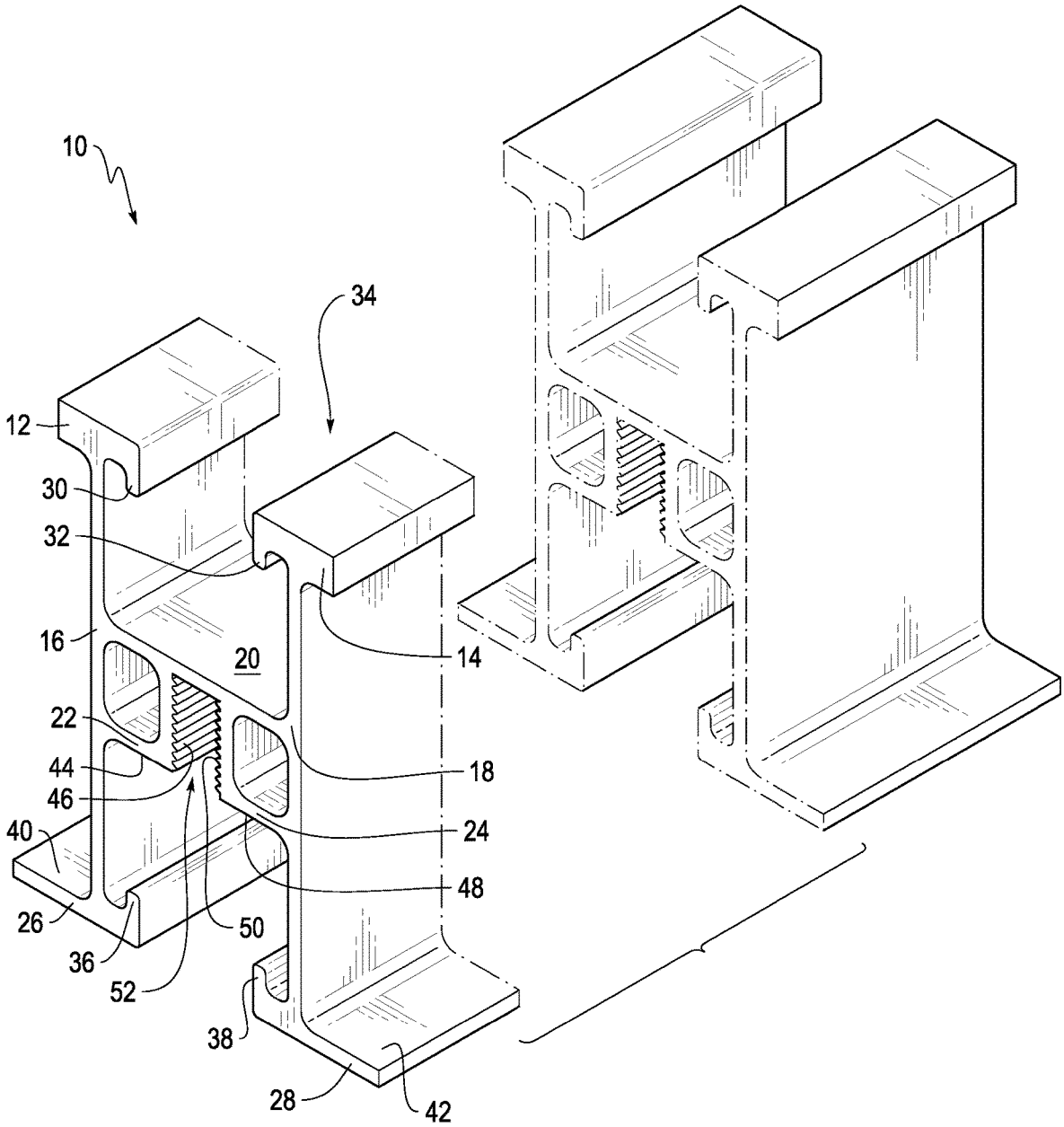
FIG. 1 is a top perspective view of an embodiment of an elongated ceiling grid member of this invention.
Figure 2:
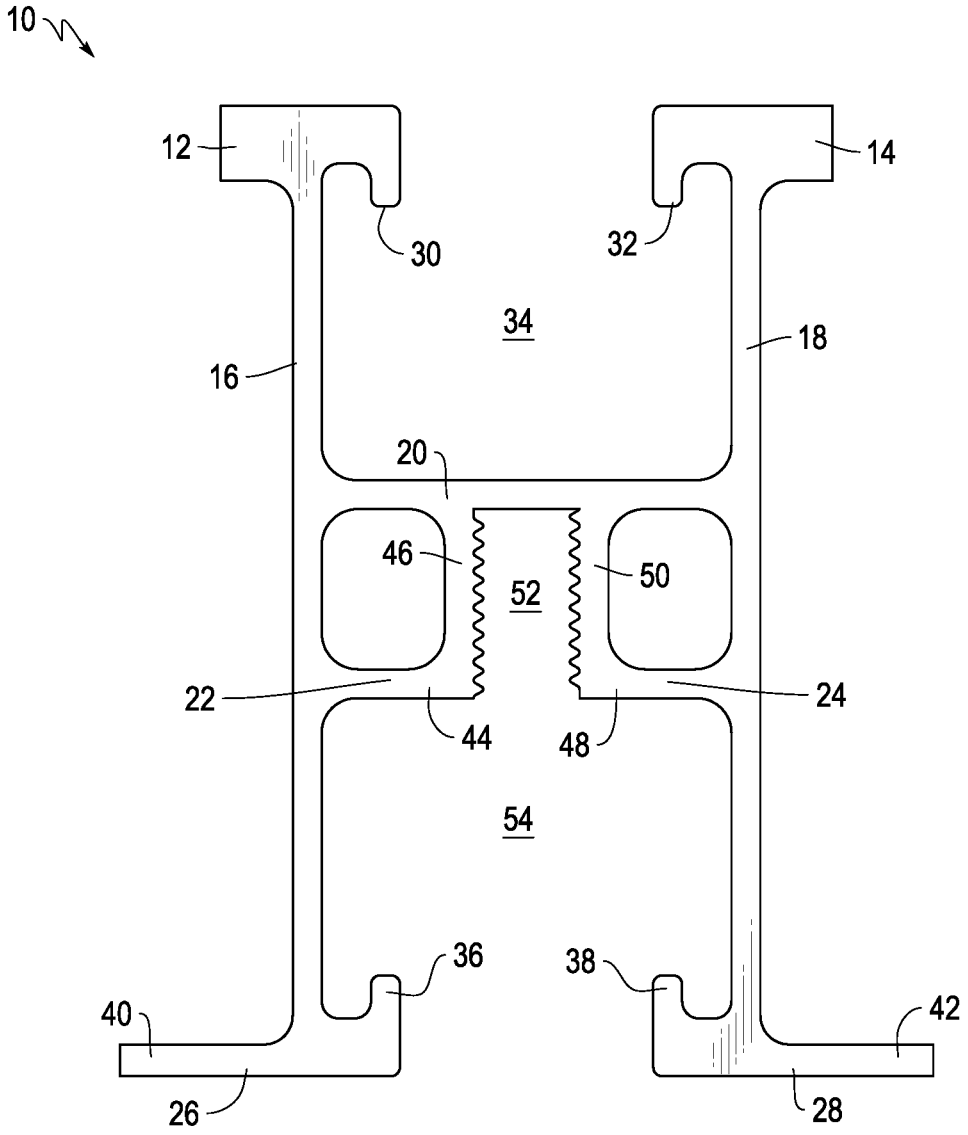
FIG. 2 is an elevation view of one end of the embodiment of the elongated ceiling grid member of this invention illustrated in FIG. 1.
Figure 3:
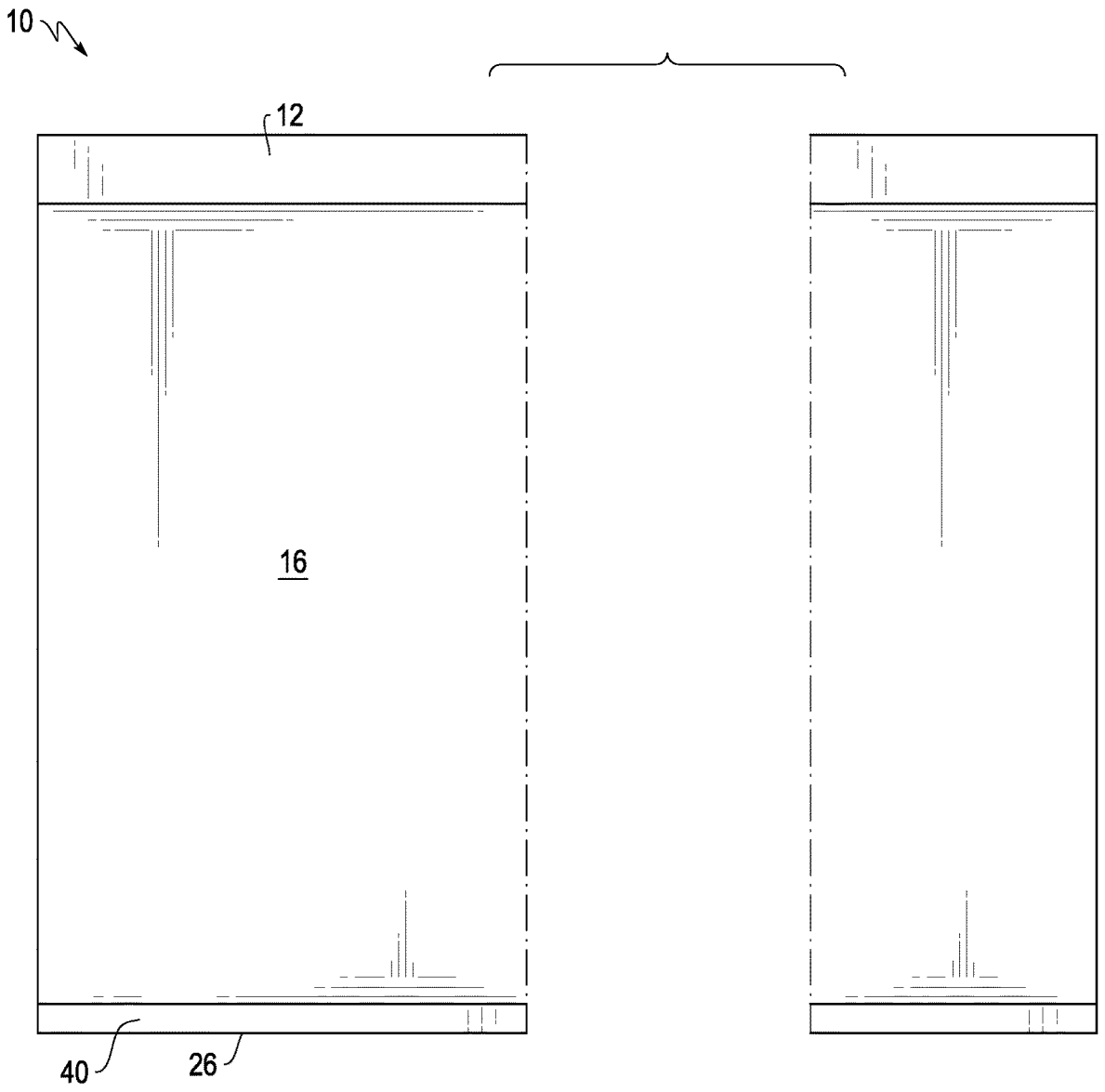
FIG. 3 is a side elevation view of the embodiment of the elongated ceiling grid member of this invention illustrated in FIGS. 1 and 2.
Figure 4:
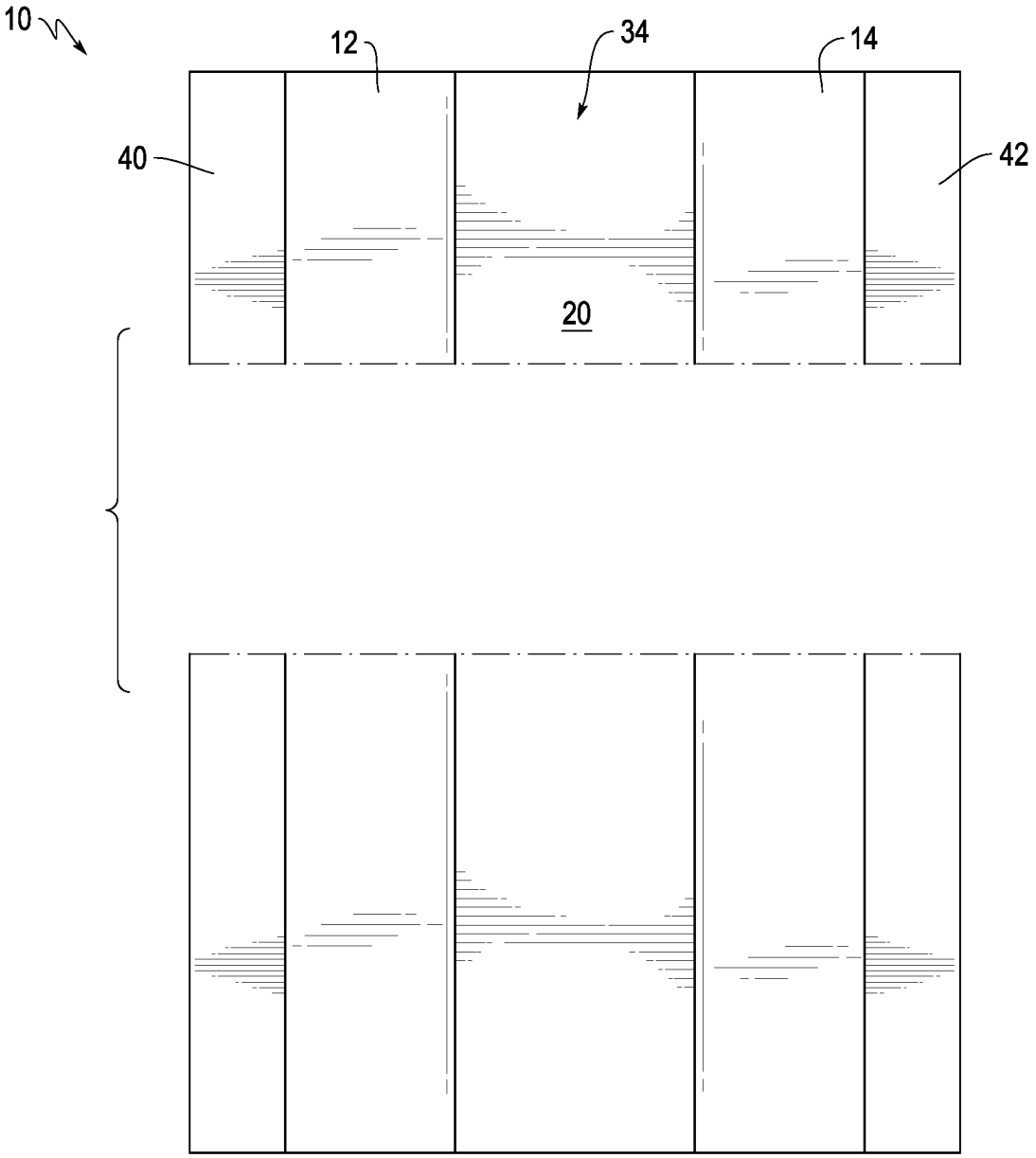
FIG. 4 is a top plan view of the embodiment of the elongated ceiling grid member of this invention illustrated in FIGS. 1-3.
Figure 5:
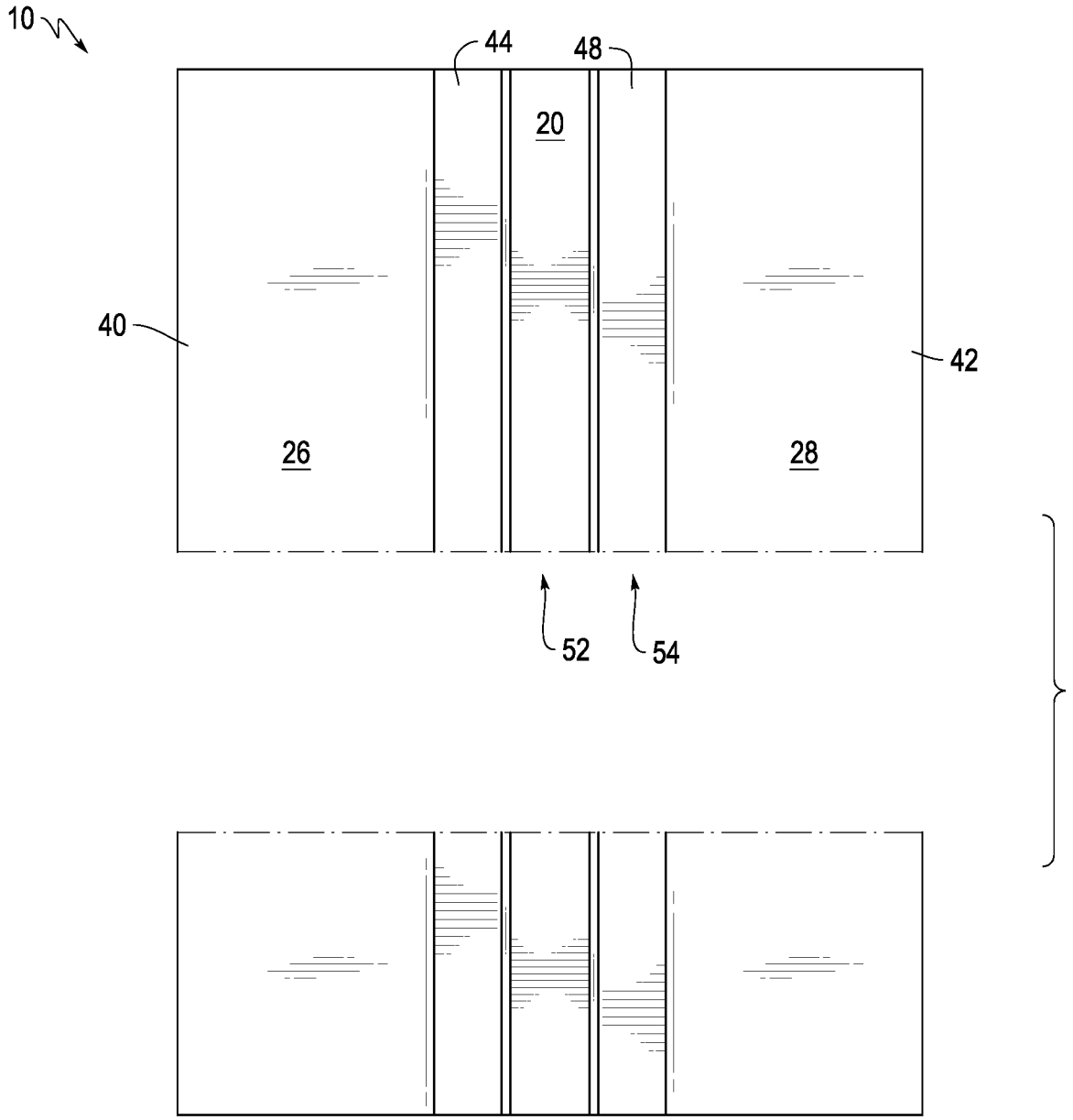
FIG. 5 is a bottom plan view of the embodiment of the elongated ceiling grid member of this invention illustrated in FIGS. 1-4.

As stated, an embodiment of an elongated ceiling grid member of this invention is illustrated in FIGS. 1-7, elongated ceiling grid member 10.

As shown in those figures, elongated ceiling grid member 10 includes upper flanges 12 and 14, vertical side walls 16 and 18, horizontal wall 20, mid sections 22 and 24 and lower flanges 26 and 28, which all extend along the longitudinal axis of elongated ceiling grid member 10, the entire length of elongated ceiling grid member 10.

While, in this embodiment of the elongated ceiling grid members of this invention, upper flanges 12 and 14, vertical side walls 16 and 18, horizontal wall 20, mid sections 22 and 24 and lower flanges 26 and 28 are integral, in other embodiments of the elongated ceiling grid members of this invention, one or more of those flanges, walls and/or mid sections can be separate members that are joined to other members that comprise one or more of the other flanges, walls and/or mid sections.

Upper flanges 12 and 14 include hooks or tongues 30 and 32, respectively, that extend downwardly at the innermost edges of upper flanges 12 and 14 and are spaced inwardly from vertical side walls 16 and 18, respectively.

Horizontal wall 20 extends between vertical side walls 16 and 18.

An upper portion of elongated ceiling grid member 10 includes upper flanges 12 and 14, horizontal wall 20 and the upper portions of vertical side walls 16 and 18 above horizontal wall 20.

Upper space 34 is defined by the upper portion; specifically, by the top surface of horizontal wall 20, the inside surfaces of the upper portions of vertical side walls 16 and 18 above horizontal wall 20 and the lowermost and innermost surfaces of upper flanges 12 and 14 that are inside of vertical side walls 16 and 18. Upper space 34 opens to the top of the upper portion through an opening defined by the innermost edges of upper flanges 12 and 14.

Lower flanges 26 and 28 include (a) hooks or tongues 36 and 38, respectively, that extend upwardly at the innermost edges of lower flanges 26 and 28 and are spaced inwardly from vertical side walls 16 and 18, respectively, and (b) support portions 40 and 42 that extend outwardly from vertical side walls 16 and 18, respectively.

Mid sections 22 and 24 extend inwardly from vertical sidewalls 16 and 18, respectively. Mid section 22 includes bottom wall 44 and threaded side wall 46. Bottom wall 44 extends inwardly from vertical side wall 16. Threaded side wall 46 extends from the innermost end of bottom wall 44 to horizontal wall 20. Mid section 24 includes bottom wall 48 and threaded side wall 50. Bottom wall 48 extends inwardly from vertical side wall 18. Threaded side wall 50 extends from the innermost end of bottom wall 48 to horizontal wall 20.

A lower portion of elongated ceiling grid member 10 includes lower flanges 26 and 27, bottom walls 44 and 48 and the lower portions of vertical side walls 16 and 18 below bottom walls 44 and 48.

Lower space 54 is defined by the lower portion; specifically, by the uppermost and innermost surfaces of lower flanges 26 and 28 that are inside of vertical side walls 16 and 18, the inside surfaces of the lower portions of vertical side walls 16 and 18 below bottom walls 44 and 48, and the bottom surfaces of bottom walls 44 and 48. Lower space 54 opens to the bottom of the lower portion through an opening defined by the innermost surfaces of lower flanges 26 and 28.

A middle portion of elongated ceiling grid member 10 includes threaded side walls 46 and 50, which face each and are parallel, such that elongated threaded opening 52 is formed by and between threaded side walls 46 and 50.

Figure 6:
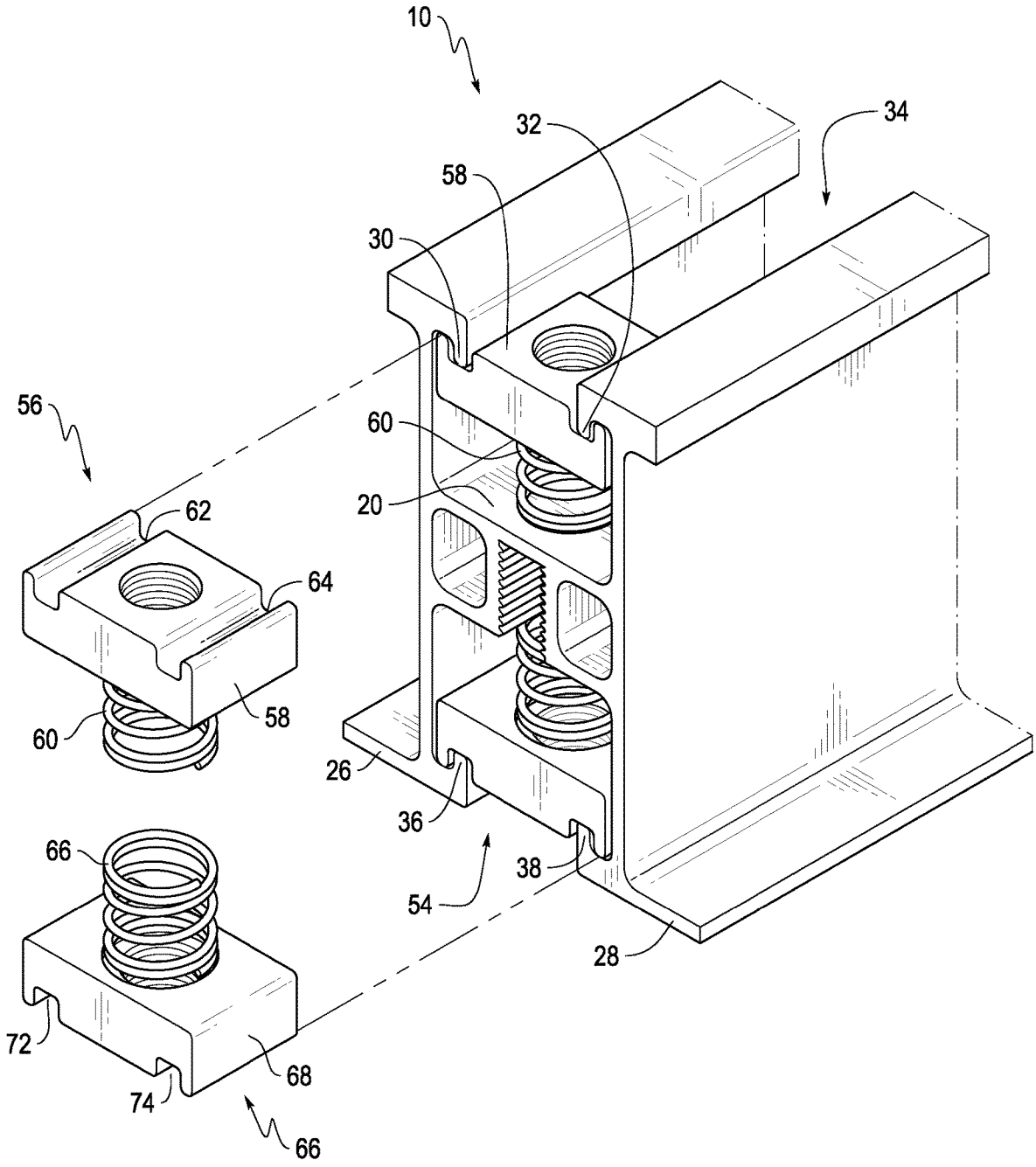
FIG. 6 is a top perspective view of the embodiment of the elongated ceiling grid member of this invention illustrated in FIGS. 1-5, showing channel nut and spring assemblies in top and bottom spaces of the elongated ceiling grid member.
Figure 7:
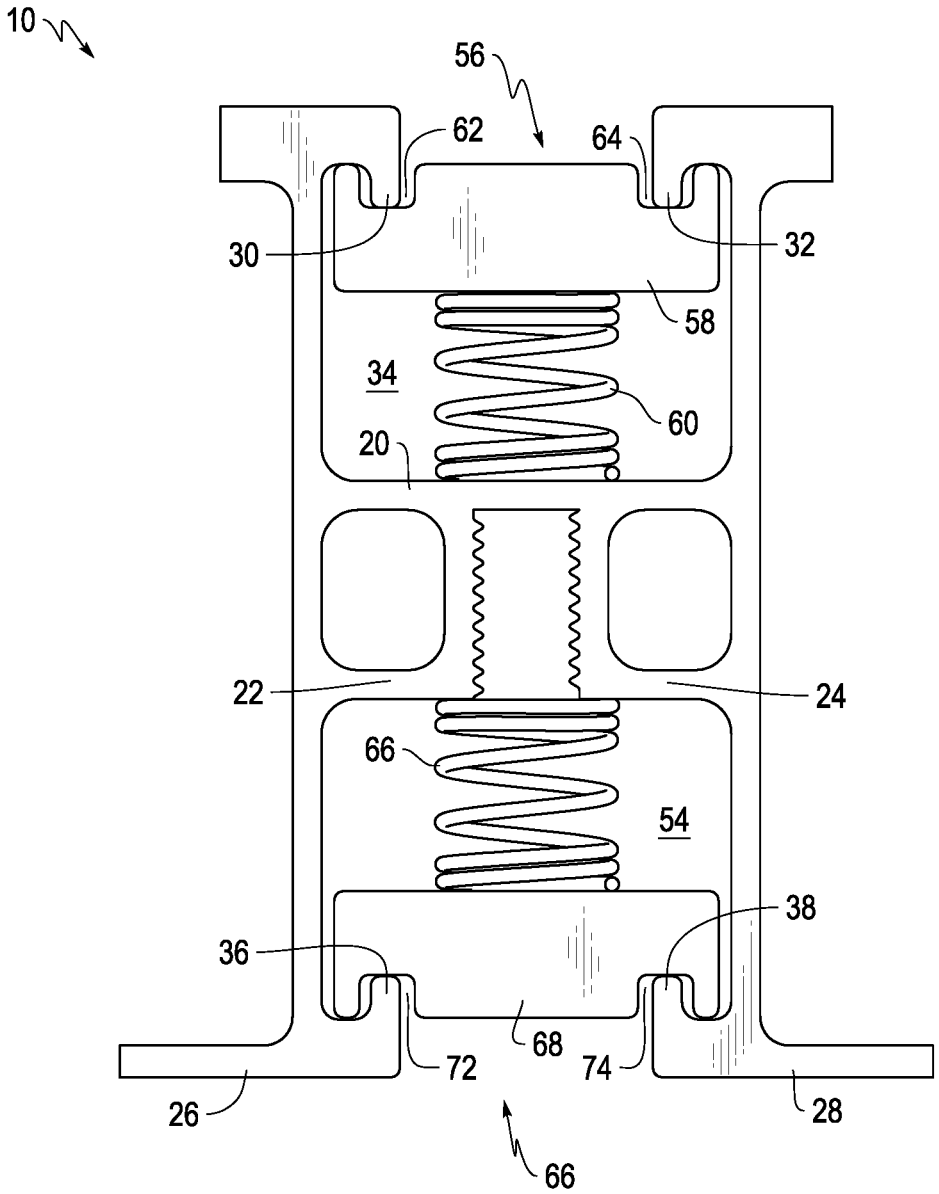
FIG. 7 is an elevation view of one end of the embodiment of the elongated ceiling grid member illustrated in FIGS. 1-6, showing the channel nut and spring assemblies illustrated in FIG. 6 in the top and bottom spaces of the elongated ceiling grid member.

In this embodiment of the invention, upper space 34 is designed to receive and retain a channel nut and spring assembly, such as channel nut and spring assembly 56, as shown in FIGS. 6 and 7.

Channel nut and spring assembly 56 includes channel nut 58 and coil spring 60. Channel nut 58 has elongated grooves 62 and 64 that receive and engage tongues 30 and 32 of upper flanges 12 and 14, respectively. Coil spring 60 is compressed between the bottom surface of channel nut 58 and the top surface of horizontal wall 20 to provide a force pushing channel nut 58 against flanges 12 and 14. Channel nut 58 can be attached to a threaded rod, as explained below.

Further, in this embodiment of the invention, lower space 54 is also designed to receive and retain a channel nut and spring assembly, such as channel nut and spring assembly 66, as also shown in FIGS. 6 and 7.

Channel nut and spring assembly 66 includes channel nut 68 and coil spring 70. Channel nut 68 has elongated grooves 72 and 74 that receive and engage tongues 36 and 38 of lower flanges 26 and 28, respectively. Coil spring 70 is compressed between the top surface of channel nut 68 and bottom walls 44 and 48 to provide a force pushing channel nut 68 against lower flanges 26 and 28. A threaded support member for structure or accessories to be supported by and suspended from elongated ceiling grid member 10 can threadedly engage channel nut 68.

Threaded opening 52 can also receive threaded support members for structure and accessories to be supported by and suspended from elongated ceiling grid member 10. Threaded side walls 46 and 50 can be spaced such that threaded opening 52 can receive threaded members of different sizes than can be received in channel nut 68.

Support portions 40 and 42 of lower flanges 26 and 28 are designed to support ceiling tiles and other members which are placed on and supported by support portions 40 and 42.

The elongated ceiling grid members of this invention, such as elongated ceiling grid member 10, can be utilized as follows.

A plurality of the elongated ceiling grid members are arranged end-to-end in parallel and perpendicular rows to form an array or a grid of the members. The adjacent ends of elongated ceiling grid members forming the array or grid are connected. One way of connecting the adjacent ends of elongated ceiling grid members 10 is explained next.

A channel nut and spring assembly 56 can be inserted in upper space 34 of each of the elongated ceiling grid members 10 forming a junction, at or near the end of the each of elongated ceiling grid members 10 at the junction, as shown in FIGS. 6 and 7 and discussed above. Specifically, each channel nut and spring assembly 56 is inserted such that tongues 30 and 32 of upper flanges 12 and 14 are received in grooves 62 and 64, respectively, of channel nut 58. Coil spring 60 pushes channel nut 58 upward, to maintain the engagement of tongue 30 in groove 62 and tongue 32 in groove 64.

Threaded members can then be attached to the channel nuts 58 in the adjacent ends of the elongated ceiling grid members 10. Those threaded members extend upwardly from channel nuts 58, through the openings defined by the innermost edges of upper flanges 12 and 14. A connection member that spans the junction can be attached to those threaded members to secure the junction or intersection. A stable grid or array of elongated ceiling grid members 10 can be formed in that manner.

That grid or array of the elongated ceiling grid members of this invention can be attached to building structure above that grid or array, such that the grid or array is supported by and suspended from that building structure. One way of attaching a grid or array of elongated ceiling grid members 10 to building structure is as follows.

Channel nut and spring assemblies 56 can be inserted into upper spaces 34 of the elongated ceiling grid members 10 forming the grid or array at points along the grid or array where support from the above building structure is desired and possible. Those channel nut and spring assemblies 56 are inserted in upper spaces 34 as described above and illustrated in FIGS. 6 and 7.

The lower ends of threaded members are attached to those channel nuts 58. The upper ends of those threaded members are attached to the above building structure.

While, in this embodiment of the invention, upper spaces 34, upper flanges 12 and 14 and channel nut and spring assemblies 56 are utilized to receive and retain the lower ends of threaded members that are connected to the above building structure and/or to connectors that span and connect adjacent ends of the elongated ceiling grid members 10 in an grid or array, the elongated ceiling grid members of other embodiments of this invention can have structure other than the structure defining upper spaces 34 and channel nut and spacing assemblies 56 that receives and retains those threaded member lower ends.

Once a grid or array of elongated ceiling grid members 10 is installed as desired, other equipment and structural members can be attached to those members 10, to be suspended below those members 10, in at least the following ways.

First, channel nut and spring assemblies 66 can be installed in lower spaces 54 of elongated ceiling grid members 10 at locations where support for other equipment and structure is needed. Specifically, as discussed above and illustrated in FIGS. 6 and 7, channel nut and spring assemblies 66 are inserted in the desired locations in lower spaces 54 such that tongues 36 and 38 of lower flanges 26 and 28 are received in grooves 72 and 74, respectively, of channel nuts 68. Coil springs 70 push tongues 36 and 38 into engagement with grooves 72 and 74, respectively.

The upper ends of threaded members can then be attached to channel nuts 68. Those threaded members extend downwardly, through the opening defined by the innermost edges of lower flanges 26 and 28. The lower ends of those threaded members can be connected to equipment such as cable trays and electrical busbars, such that that equipment is supported by and suspended from elongated ceiling grid members 10.

Second, the upper ends of threaded members can be threadedly received in and retained by threaded openings 52. Those threaded members extend downwardly through lower spaces 54 and the opening defined by the innermost edge of the lower flanges 26 and 28. The lower ends of those threaded members can be attached to other structure, such as hot aisle containment partitions 50, such that that other structure is supported by and suspended from the grid of elongated ceiling grid members 10 by threaded openings 52.

Third, some equipment, structural members and ceiling tiles can be supported by support portions 40 and 42 of lower flanges 26 and 28, respectively.

While, in this embodiment of the invention, lower spaces 54, lower flanges 26 and 28, threaded openings 52 and channel nut and spring assemblies 66 are utilized to receive and retain the upper ends of threaded members that have other equipment and structural members attached to their lower ends, the elongated ceiling grid members of other embodiments of this invention can have structure other than the structure defining lower spaces and threaded openings 52 and 54 and channel nut and spring assemblies 66 that receive and retain those threaded member upper ends.

In general, heavier equipment and structural members with heavier loads will be attached to and supported by channel nut and spring assemblies 66 and lighter equipment and structural members with lighter loads will be attached to and supported by threaded members attached to threaded openings 52.

What is described and illustrated herein are preferred embodiments of the invention with some variations. The terms, descriptions and figures are intended to be for illustration only, and are not meant as limitations. Those skilled in the art will recognize that many variations are possible within the scope of the invention, as defined by the following claims.

What is claimed is:

1. An elongated ceiling grid member having a longitudinal axis and comprising:

an upper portion that extends along the longitudinal axis and is configured to receive and engage a first set of one or more nuts;

a lower portion that extends along the longitudinal axis and is configured to receive and engage a second set of one or more nuts; and a middle portion (i) between the upper portion and the lower portion in an up-down direction perpendicular to the longitudinal axis, (ii) that extends along the longitudinal axis and (iii) configured to receive and threadedly engage a first set of one or more threaded rods, wherein:

the lower portion and the middle portion are configured such that, when the first set of one or more threaded rods are engaged with the middle portion, the first set of the one or more threaded rods passes through the lower portion;

there is a single wall between the upper portion and the middle portion; and an outermost wall of the upper portion, the middle portion and the lower portion is a straight continuous wall.

2. The elongated ceiling grid member according to claim 1, wherein:

the upper portion (a) defines a first space that (i) extends along the longitudinal axis and (ii) is open at a first opening at a top of the upper portion and (b) is configured such that a second set of one or more threaded rods that engage the first set of nuts can pass through the first opening;

the lower portion (a) defines a second space that (i) extends along the longitudinal axis and (ii) is open at a second opening at a bottom of the lower portion and (b) is configured such that a third set of one or more threaded rods that engage the second set of one or more nuts can pass through the second opening;

the lower portion and the middle portion are configured such that, when the first set of the one or more threaded rods are engaged with the middle portion, the first set of one or more threaded rods can pass through the second opening; and the single wall divides the first space from the middle portion.

3. The elongated ceiling grid member according to claim 2, wherein:

the upper portion is configured such that the first set of one or more nuts is received in the first space; and the lower portion is configured such that the second set of one or more nuts is received in the second space.

4. The elongated ceiling grid member according to claim 3, further comprising:

a first set of one or more coil springs; and a second set of one or more coil springs, wherein the first set of one or more coil springs is (1) operatively between the upper portion and the first set of one or more nuts and (2) configured to apply a force on the first set of one or more nuts toward the first opening and the second set of one or more coil springs (1) is operatively between the lower portion and the second set of one or more nuts and (2) configured to apply a force on the second set of one or more nuts toward the second opening.

5. The elongated ceiling grid member according to claim 1, wherein the middle portion includes a pair of spaced, threaded walls configured to engage and retain the first set of the one or more threaded rods.

6. The elongated ceiling grid member according to claim 1, wherein:

the lower portion includes outwardly extending flanges that are configured to support a ceiling tile; and the outwardly extending flanges are at a lowermost end of the lower portion.

7. The elongated ceiling grid member according to claim 1, wherein:

the lower portion includes outwardly extending flanges that are configured to support a ceiling tile; and the outwardly extending flanges are at a lowermost end of the lower portion.

8. An elongated ceiling grid member having a longitudinal axis and comprising:

an upper portion that extends along the longitudinal axis and is configured to receive and engage a first set of one or more nuts;

a lower portion that extends along the longitudinal axis and is configured to receive and engage a second set of one or more nuts; and a middle portion (i) between the upper portion and the lower portion in an up-down direction perpendicular to the longitudinal axis, (ii) that extends along the longitudinal axis and (iii) configured to receive and threadedly engage a first set of one or more threaded rods, wherein:

the lower portion and the middle portion are configured such that, when the first set of one or more threaded rods are engaged with the middle portion, the first set of the one or more threaded rods passes through the lower portion; and an outermost wall of the upper portion, the middle portion and the lower portion is a straight continuous wall.

9. The elongated ceiling grid member according to claim 8, wherein:

the upper portion (a) defines a first space that (i) extends along the longitudinal axis and (ii) is open at a first opening at a top of the upper portion and (b) is configured such that a second set of one or more threaded rods that engage the first set of nuts can pass through the first opening;

the lower portion (a) defines a second space that (i) extends along the longitudinal axis and (ii) is open at a second opening at a bottom of the lower portion and (b) is configured such that a third set of one or more threaded rods that engage the second set of one or more nuts can pass through the second opening; and the lower portion and the middle portion are configured such that, when the first set of the one or more threaded rods are engaged with the middle portion, the first set of one or more threaded rods can pass through the second opening.

10. The elongated ceiling grid member according to claim 9, wherein:

the upper portion is configured such that the first set of one or more nuts is received in the first space; and the lower portion is configured such that the second set of one or more nuts is received in the second space.

11. The elongated grid ceiling member according to claim 8, wherein the middle portion includes a pair of spaced, threaded walls configured to engage and retain the first set of the one or more threaded rods.

12. The elongated ceiling grid member according to claim 8, further comprising:

a first set of one or more coil springs; and a second set of one or more coil springs, wherein the first set of one or more coil springs is (1) operatively between the upper portion and the first set of one or more nuts and (2) configured to apply a force on the first set of one or more nuts toward the first opening and the second set of one or more coil springs (1) is operatively between the lower portion and the second set of one or more nuts and (2) configured to apply a force on the second set of one or more nuts toward the second opening.

13. An elongated ceiling grid member having a longitudinal axis and comprising:

an upper portion that extends along the longitudinal axis and is configured to receive and engage a first set of one or more nuts;

a lower portion that extends along the longitudinal axis and is configured to receive and engage a second set of one or more nuts; and a middle portion (i) between the upper portion and the lower portion in an up-down direction perpendicular to the longitudinal axis, (ii) that extends along the longitudinal axis and (iii) configured to receive and threadedly engage a first set of one or more threaded rods, wherein:

the lower portion and the middle portion are configured such that, when the first set of one or more threaded rods are engaged with the middle portion, the first set of the one or more threaded rods passes through the lower portion;

the lower portion includes outwardly extending flanges that are configured to support a ceiling tile; and the outwardly extending flanges are at a lowermost end of the lower portion.

14. The elongated ceiling grid member according to claim 13, wherein:

the upper portion (a) defines a first space that (i) extends along the longitudinal axis and (ii) is open at a first opening at a top of the upper portion and (b) is configured such that a second set of one or more threaded rods that engage the first set of nuts can pass through the first opening;

the lower portion (a) defines a second space that (i) extends along the longitudinal axis and (ii) is open at a second opening at a bottom of the lower portion and (b) is configured such that a third set of one or more threaded rods that engage the second set of one or more nuts can pass through the second opening; and the lower portion and the middle portion are configured such that, when the first set of the one or more threaded rods are engaged with the middle portion, the first set of one or more threaded rods can pass through the second opening.

15. The elongated ceiling grid member according to claim 14, wherein:

the upper portion is configured such that the first set of one or more nuts is received in the first space; and the lower portion is configured such that the second set of one or more nuts is received in the second space.

16. The elongated grid ceiling member according to claim 13, wherein the middle portion includes a pair of spaced, threaded walls configured to engage and retain the first set of the one or more threaded rods.

17. The elongated ceiling grid member according to claim 13, further comprising:

a first set of one or more coil springs; and a second set of one or more coil springs, wherein the first set of one or more coil springs is (1) operatively between the upper portion and the first set of one or more nuts and (2) configured to apply a force on the first set of one or more nuts toward the first opening and the second set of one or more coil springs (1) is operatively between the lower portion and the second set of one or more nuts and (2) configured to apply a force on the second set of one or more nuts toward the second opening.

* * * * *